US005427898A

United States Patent [19]

Tang et al.

[11] Patent Number: 5,427,898

[45] Date of Patent: Jun. 27, 1995

[54] YELLOW COUPLERS HAVING AN ARLOXY COUPLING-OFF GROUP WHICH CONTAINS AN ORTHO POLARIZABLE FUNCTIONAL GROUP

[75] Inventors: Ping W. Tang; Philip T. S. Lau; Stanley W. Cowan; Terrence Mungal, all of Rochester, N.Y.

[73] Assignee: Eastman Kodak Company, Rochester, N.Y.

[21] Appl. No.: 310,104

[22] Filed: Sep. 19, 1994

Related U.S. Application Data

[63] Continuation of Ser. No. 988,080, Dec. 4, 1992, abandoned.

[51] Int. Cl.[6] ..... G03C 7/36

[52] U.S. Cl. ..... 430/389; 430/557

[58] Field of Search ..... 430/389, 557, 558

[56] References Cited

U.S. PATENT DOCUMENTS

| | | | |
|---|---|---|---|
| 2,298,443 | 10/1942 | Weissberger et al. | 95/6 |
| 2,407,210 | 9/1946 | Weissberger | 95/6 |
| 2,875,057 | 2/1959 | McCrossen | 96/100 |
| 3,265,506 | 8/1966 | Weissberger et al. | 96/100 |
| 3,408,194 | 10/1968 | Loria | 96/100 |
| 3,419,391 | 12/1968 | Young | 96/56.5 |
| 3,447,928 | 6/1969 | Loria | 96/100 |
| 3,476,563 | 11/1969 | Loria | 96/100 |
| 3,644,498 | 2/1972 | Loria | 260/507 |
| 3,822,248 | 7/1974 | Loria | 260/207 |
| 4,157,919 | 6/1979 | Lau | 96/100 |
| 4,230,851 | 10/1980 | Renner et al. | 544/183 |
| 4,248,962 | 2/1981 | Lau | 430/382 |
| 4,327,175 | 4/1982 | Toda et al. | 430/546 |
| 4,336,327 | 6/1982 | Tanaka et al. | 430/556 |
| 4,401,752 | 8/1983 | Lau | 430/385 |
| 4,529,691 | 7/1985 | Renner et al. | 430/556 |
| 4,741,994 | 5/1988 | Ichijima et al. | 430/555 |
| 4,758,501 | 7/1988 | Buckland et al. | 430/557 |
| 4,824,773 | 4/1989 | Sato et al. | 430/557 |
| 5,118,599 | 6/1992 | Lau et al. | 430/556 |

FOREIGN PATENT DOCUMENTS

| | | | |
|---|---|---|---|
| 0447969 | 9/1991 | European Pat. Off. . | |
| 2153955 | 7/1987 | Japan | 430/557 |
| 3133151 | 6/1988 | Japan | 430/557 |
| 4344640 | 12/1992 | Japan . | |

*Primary Examiner*—Lee C. Wright

*Attorney, Agent, or Firm*—Arthur E. Kluegel

[57] ABSTRACT

Novel yellow dye-forming couplers, and photographic elements, emulsions and processes for developing images utilizing the novel couplers, are disclosed. The novel couplers include (a) an acyl acetanilide in which the acyl group has a monocyclic or multicyclic carbon center attached to the carbonyl moiety, and (b) an aryloxy coupling-off group at the coupling position of the acylacetanilide, the coupling-off group having in the ortho position a polarizable substituent.

18 Claims, No Drawings

YELLOW COUPLERS HAVING AN ARLOXY COUPLING-OFF GROUP WHICH CONTAINS AN ORTHO POLARIZABLE FUNCTIONAL GROUP

This application is a continuation of application Ser. No. 07/988,080, filed Dec. 4, 1992.

BACKGROUND OF THE INVENTION

This invention pertains to a new class of yellow dye-forming couplers and to silver halide color photographic light-sensitive elements, emulsions and processes comprising such couplers. More specifically, the invention pertains to a new class of yellow couplers having a combination of a monocyclic or multicyclic carbon center attached to the 2-position of a substituted phenyl carbamoyl acetyl group and an aryloxy coupling-off group having a polarizable carbonyl, sulfonyl, sulfinyl, phosphonyl or phosphinyl moiety in the ortho position.

It is well known in the photographic art that color images are customarily obtained by a reaction between an oxidized aromatic primary amine developer and a color forming coupler. Typically, yellow dye-forming couplers are open chain ketomethylene compounds which yield azomethine dyes upon coupling with an oxidized developer. The most common yellow couplers are acylacetanilides, such as pivaloylacetanilides and benzoylacetanilides. Pivaloylacetanilide yellow couplers which are frequently used in the art have, in general, low coupling efficiencies due to their high $pK_a$ values. To overcome this problem, benzoylacetanilide couplers have been proposed and employed in the art. However, benzoylacetanilide yellow couplers yield image dyes with very poor light stability.

The foregoing classes of yellow couplers are described, for example, in U.S. Pat. Nos. 2,298,443; 2,407,210; 2,875,057; 3,048,194; 3,265,506; 3,447,928; 4,157,919; 4,230,851; 4,327,175; and 4,529,691, and in "Farbkuppler—ein Literaturübersicht," published in AGFA MITTEILUNGEN, Band III, pp. 112–126 (1961).

Although the aforementioned classes of yellow dye-forming couplers are frequently used in the photographic art, they nevertheless are still characterized by unsatisfactory coupling efficiency, image dye stability, solubility and dispersion stability. There has thus been a continuing search for novel couplers which improve upon existing couplers and optimize specific properties for particular applications. Among the photographically important properties, the coupling efficiency is of high interest. To enhance the coupling efficiency, 2-equivalent yellow couplers are disclosed and frequently used in the art. In particular, 2-equivalent yellow couplers having an aryloxy group as the coupling-off group have, in fact, attracted widespread attention. Yellow couplers having aryloxy coupling-off groups are disclosed, for example, in U.S. Pat. Nos. 3,408,194; 3,419,391; 3,429,391; 3,476,563; 3,644,498; 3,822,248; and 4,248,962.

U.S. Pat. No. 4,401,752 discloses that the coupling efficiency of pivaloylacetanilide-class yellow couplers can be improved with an aryloxy coupling-off group in which a polarizable carbonyl, sulfonyl or phosphonyl group is attached to the phenyl group at the ortho position.

One of the most effective of the many aryloxy coupling-off groups capable of enhancing the coupling efficiency of the pivaloylacetanilide-class yellow couplers is the sulfonyldiphenol (SDP) coupling-off group. The SDP coupling-off group affords superior coupling efficiency by virtue of the presence of the ionizable hydroxy group. However, while the SDP coupling-off group successfully enhances the coupling efficiency of the pivaloylacetanilide-class yellow couplers, it enhances coupling efficiency to a lesser extent when employed with two important new classes of yellow couplers, the 5-alkyl-1,3-dioxanoylacetanilide-class and the adamantoylacetanilide-class couplers, which are disclosed, for example, in U.S. Pat. Nos. 5,118,599 and 4,336,327.

There has thus been a continuing need for new coupling-off groups capable of enhancing the coupling efficiency of the dioxanyl- and adamantoylacetanilide-class yellow couplers.

SUMMARY OF THE INVENTION

These needs have been satisfied by providing a yellow dye-forming coupler comprising an acyl acetanilide in which the acyl group includes a monocyclic or multicyclic carbon center attached to the carbonyl moiety, and an aryloxy coupling-off group at the coupling position of the acyl acetanilide, the coupling-off group having in the ortho position a polarizable substituent.

It has now been discovered that an aryloxy coupling-off group with an ortho polarizable substituent significantly enhances the coupling efficiency of dioxanyl- and adamantoylacetanilide-class couplers in particular, as well as other classes of yellow couplers.

In another embodiment, the invention relates to a photographic element comprising a support and a silver halide emulsion layer having associated therewith a yellow dye-forming coupler as described above.

In yet another embodiment, this invention relates to a process for developing an image in a photographic element by developing it in the presence of a yellow dye-forming coupler as described above.

In still another embodiment, this invention relates to a photographic silver halide emulsion comprising a yellow dye-forming coupler as described above.

DETAILED DESCRIPTION OF THE INVENTION

The yellow dye-forming coupler according to the invention comprises an acyl acetanilide in which the acyl group includes a monocyclic or multicyclic carbon center attached to the carbonyl moiety, and an aryloxy coupling-off group at the coupling position of the acyl acetanilide. According to the invention, the aryloxy coupling-off group has a polarizable substituent in the ortho position. The term "monocyclic or multicyclic carbon center" as used herein denotes a carbon atom which is part of one or more non-aromatic ring systems. The term "polarizable substituent" denotes a group of atoms whose electrons can be readily induced to shift due to differences in electronegativity to give a positive or fractional positive charge at one end and a negative or fractional negative charge at the other end of the molecule.

Preferred yellow dye-forming couplers according to the invention can be represented by the formula

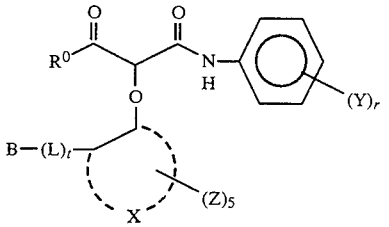

wherein $R^0$ denotes

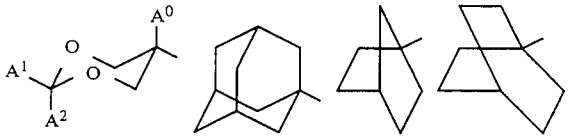

$A^0$ denotes unsubstituted or substituted alkyl, aryl or aralkyl;

$A^1$, $A^2$ independently denote hydrogen or unsubstituted or substituted alkyl, aryl or aralkyl;

L denotes a linking group;

B denotes a moiety containing a polarizable functional group;

X denotes the atoms necessary to complete a phenyl or naphthyl ring system;

Y denotes hydrogen, halogen, CN, $CF_3$, $—C(O)_nR^1$, $—CR^1R^2C(O)_nR^1$, $—CR^1R^2CONR^1R^2$, $—COO(CH_2—CH_2—O)_pR^1$, $—CONR^1R^2$, $—CONR^1(CH_2CH_2—O)_pR^2$, $—NO_2$, $—NR^1S(O)_nR^2$, $—NR^1S(O)_nNR^1R^2$, $—NR^1COR^2$, $—NR^1COCH(R^1)(OR^2)$, $—NR^1CONR^1R^2$, $—OR^1$, $—O(CH_2)_qR^1$, $—O(CH_2—CH_2—O)_pR^1$, $—O(CH_2—CH_2—O)_pCOOR^1$, $—O(CH_2—CH_2—O)_pCONR^1R^2$, $—S(O)_nR^1$, $—S(O)_nNR^1R^2$, or $—S(O)_nNR^1(CH_2CH_2—O)_pR^2$;

$R^1$,$R^2$ independently denote hydrogen or unsubstituted or substituted alkyl, aryl or heterocyclyle, or together complete a heterocyclic ring with the nitrogen, oxygen or phosphorus atoms to which they are attached;

Z denotes hydrogen, halogen, —CN, $—CF_3$, $—C(O)_nR^1$, $—CR^1R^2C(O)_nR^1$, $—CR^1R^2CONR^1R^2$, $—CONR^1R^2$, $—CONR^1(CH_2CH_2—O)_pR^2$, $—NO^2$, $—S(O)_nR^1$, $—S(O)_nNR^1R^2$, $—S(O)_nNR^1(CH_2CH_2—O)_pR^2$, $—SO_2F$, or $—SO_2CF_3$;

n denotes 1 or 2;

p, q, s independently denote an integer from 1 to 3; and r denotes an integer from 1 to 4.

Each substituent Y is independently the same or different.

Exemplary $R^0$ groups include adamantyl, 5-methyl-1,3-dioxanyl, bicyclo[2.2.1]heptyl and bicyclo[2.2.2.]octyl.

$A^0$, $A^1$ and $A^2$ preferably denote an alkyl group, particularly a methyl group.

Linking group L can be any group employed in the art to link a carbonyl function. Exemplary linking groups include —NH— and $—CH_2—$.

B preferably is a carbonyl, sulfonyl, sulfinyl, phosphonyl or phosphinyl group free of photographic dye groups or releasable photographically useful groups. Particularly preferably, B is a moiety selected from the group consisting of: $—CO_2R^1$, $—CONR^1R^2$, $—NR^1COR^2$, $—NR^1CONR^1R^2$, $—S(O)_nNR^1R^2$, $—NR^1S(O)_nR^2$, $—NR^1S(O)_nNR^1R^2$, $—P(O)R^1R^2$, and $—P(O)(OR^1)(OR^2)$, wherein all substituents are as defined above.

In general, the alkyl and aryl portions of the foregoing groups contain 1 to 20 carbon atoms (alkyl) and 6 to 20 carbon atoms (aryl). They can be substituted with halogen, hydroxy, cyano, carboxy, alkoxy, aryloxy, alkoxycarbonyl, aryloxycarbonyl, amido ($—NR^1COR^2$), carbamoyl ($—CONR^1R^2$), alkylsulfinyl, alkylsulfonyl, hydroxyalkylsulfonyl, sulfonamido ($—NR^1SO_2R^2$), and sulfamoyl ($—SO_2NR^1R^2$).

Exemplary preferred aryloxy coupling-off groups are disclosed at cols. 3–4 in U.S. Pat. No. 4,401,752, the entire disclosure of which is incorporated by reference.

Preferred coupling-off groups include the following:

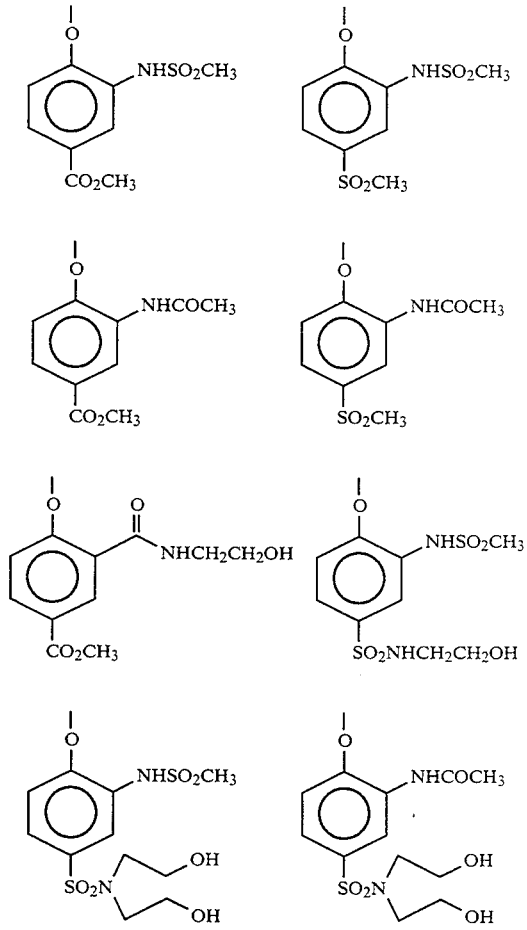

Exemplary embodiments of yellow couplers within the scope of the present invention appear below:

Y-1)
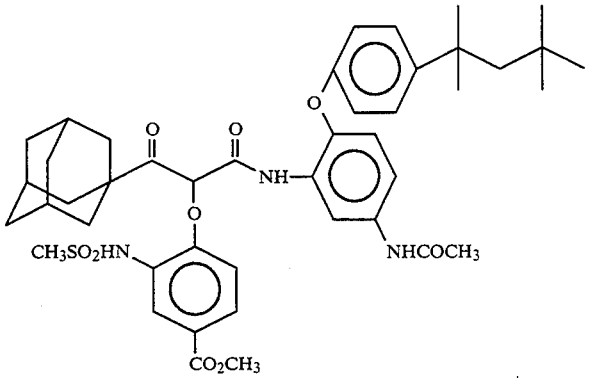
Y-2)
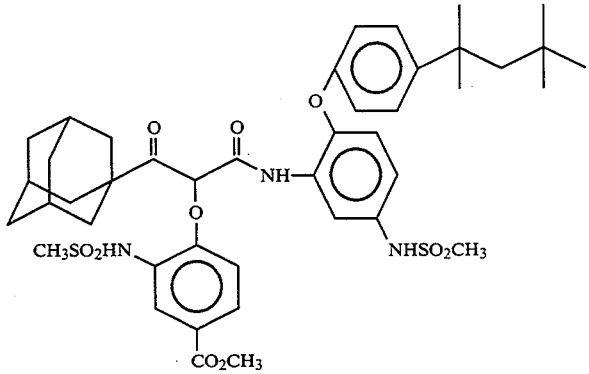
Y-3)
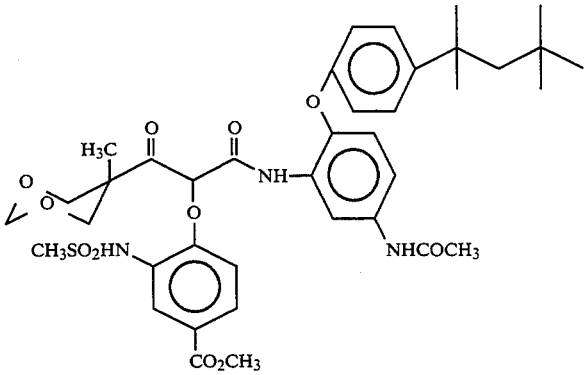
Y-4)
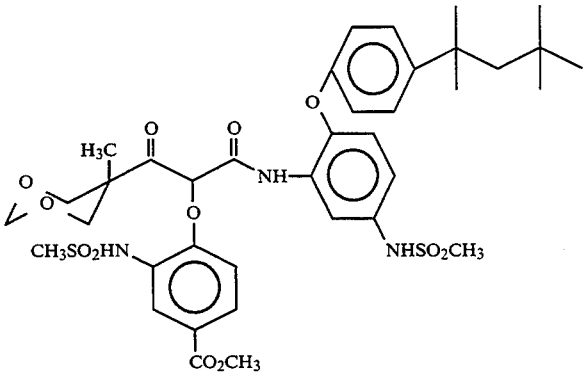

-continued
Y-5)
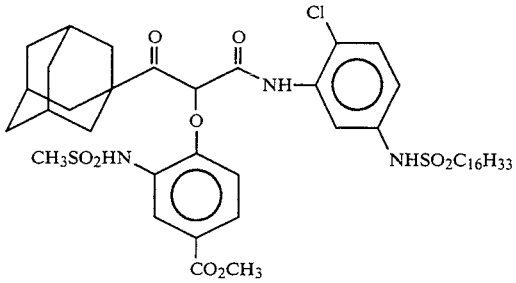
Y-6)
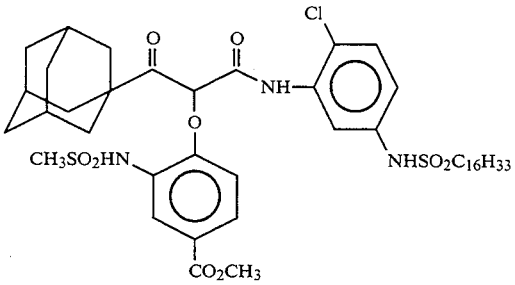
Y-7)
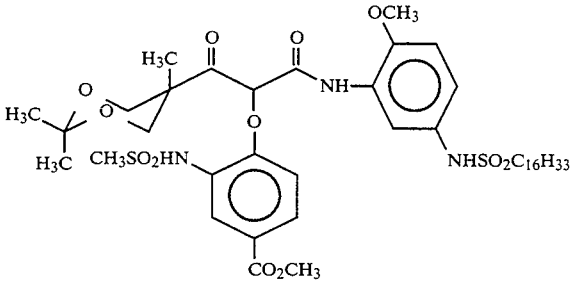
Y-8)
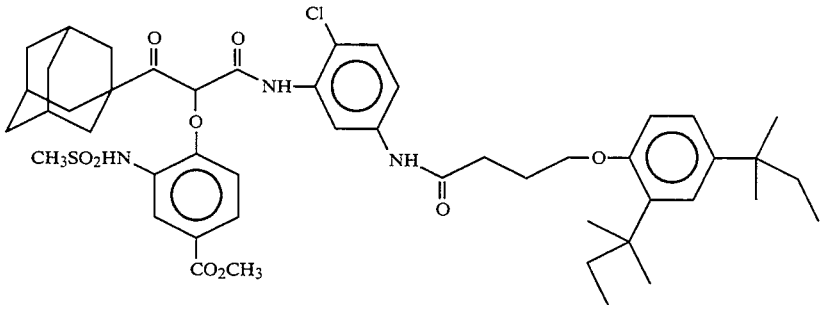
Y-9)
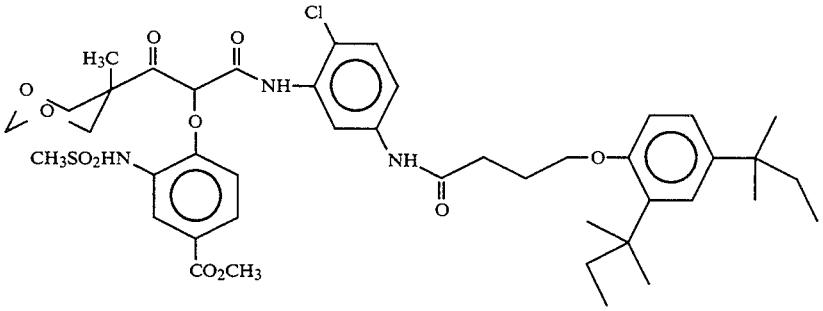

-continued
Y-10)
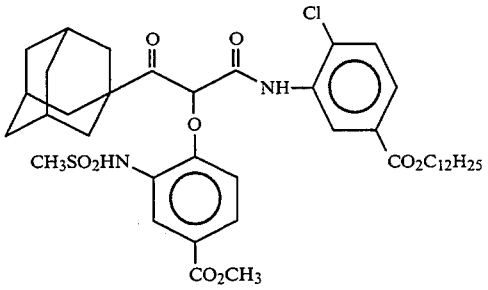
Y-11)
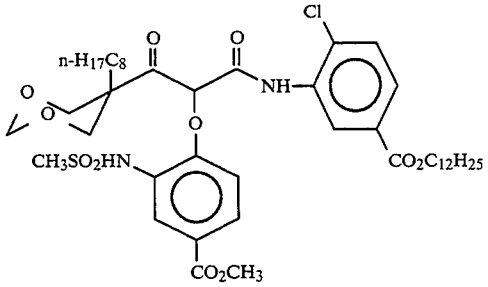
Y-12)
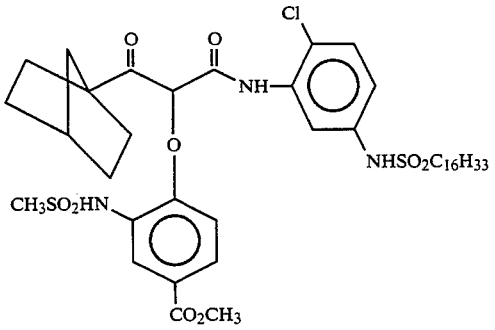
Y-13)
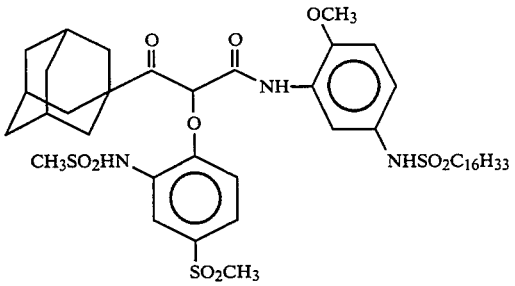
Y-14)
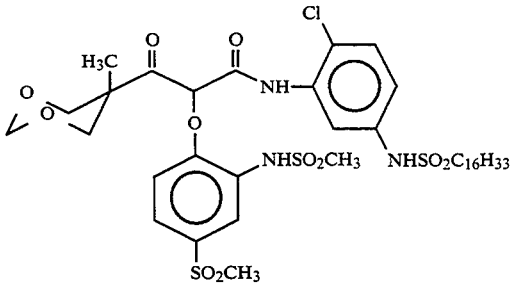

-continued
Y-15)
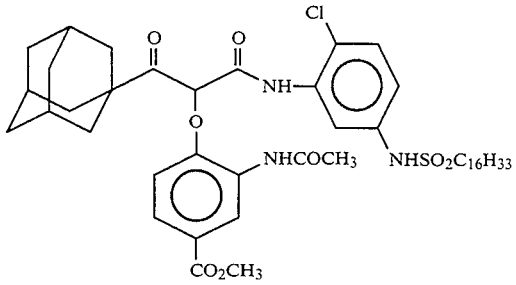
Y-16)
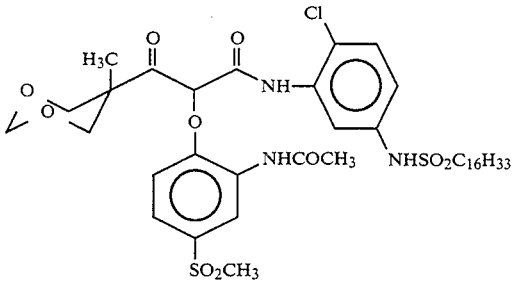
Y-17)
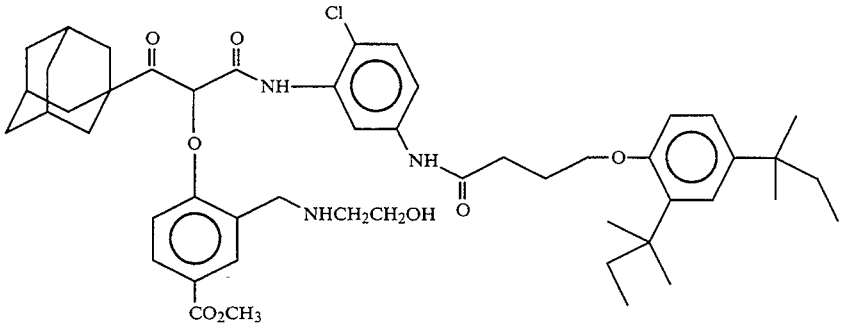
Y-18)
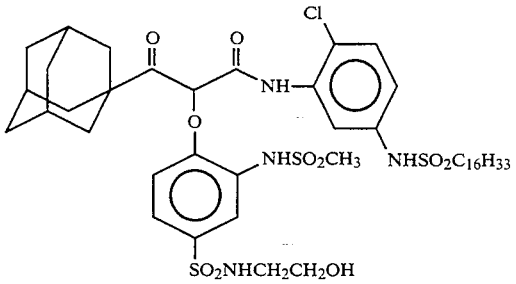
Y-19)
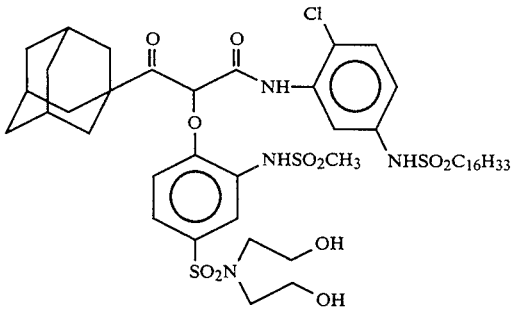

-continued

Y-20)

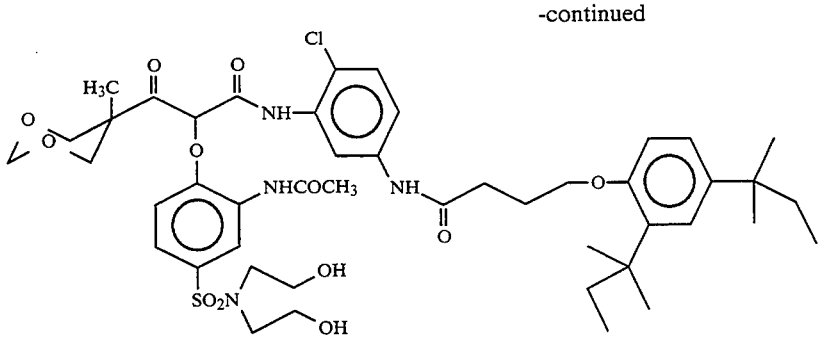

Preferably, the couplers according to the invention are incorporated in silver halide emulsions and the emulsions are coated on a support to form a photographic element. Alternatively, the inventive couplers can be incorporated in photographic elements adjacent the silver halide emulsion where, during development, the coupler will be in reactive association with development products such as oxidized color developing agent. Thus, as used herein, the term "associated therewith" signifies that the coupler is in a silver halide emulsion layer or in an adjacent location where, during processing, it will come into reactive association with silver halide development products. The amount of coupler to be incorporated in an emulsion is generally between about $5\times10^4$ and $5\times10^{-3}$ mole/$m^2$.

In a preferred embodiment, the inventive coupler can be ballasted. In one preferred embodiment, at least one group Y is a ballast group. Ballast groups, if employed, comprise groups of such molecular size and configuration as to render the inventive coupler nondiffusible as described, for example, in U.S. Pat. Nos. 4,420,556 and 4,923,789. Advantageous ballast groups include alkyl and aryl groups having from about 8 to 32 carbon atoms.

Unballasted couplers can be used in a Kodachrome-type process.

In the following discussion of suitable materials for use in the emulsions and elements according to the invention, reference will be made to *Research Disclosure,* December 1989, Item 308119, published by Kenneth Mason Publications Ltd., Emsworth, Hampshire PO10 7DQ, U.K., the disclosures of which are incorporated in their entireties herein by reference. This publication will be identified hereafter as "Research Disclosure".

The support of the element of the invention can be any of a number of well known supports for photographic elements. These include polymeric films, such as cellulose esters (for example, cellulose triacetate and diacetate) and polyesters of dibasic aromatic carboxylic acids with divalent alcohols (such as polyethylene terephthalate), paper, and polymer-coated paper.

The photographic elements according to the invention can be coated on the selected supports as described in Research Disclosure Section XVII and the references cited therein.

The radiation-sensitive layer of a photographic element according to the invention can contain any of the known radiation-sensitive materials, such as silver halide, or other light sensitive silver salts. Silver halide is preferred as a radiation-sensitive material. Silver halide emulsions can contain for example, silver bromide, silver chloride, silver iodide, silver chlorobromide, silver chloroiodide, silver bromoiodide, or mixtures thereof. The emulsions can include coarse, medium, or fine silver halide grains bounded by 100, 111, or 110 crystal planes.

The silver halide emulsions employed in the elements according to the invention can be either negative-working or positive-working. Suitable emulsions and their preparation are described in Research Disclosure Sections I and II and the publications cited therein.

Also useful are tabular grain silver halide emulsions. In general, tabular grain emulsions are those in which greater than 50 percent of the total grain projected area comprises tabular grain silver halide crystals having a grain diameter and thickness selected so that the diameter divided by the mathematical square of the thickness is greater than 25, wherein the diameter and thickness are both measured in microns. An example of tabular grain emulsions is described in U.S. Pat. No. 4,439,520.

Suitable vehicles for the emulsion layers and other layers of elements according to the invention are described in Research Disclosure Section IX and the publications cited therein.

The radiation-sensitive materials described above can be sensitized to a particular wavelength range of radiation, such as the red, blue, or green portions of the visible spectrum, or to other wavelength ranges, such as ultraviolet, infrared, X-ray, and the like. Sensitization of silver halide can be accomplished with chemical sensitizers such as gold compounds, iridium compounds, or other group VIII metal compounds, or with spectral sensitizing dyes such as cyanine dyes, merocyanine dyes, or other known spectral sensitizers. Exemplary sensitizers are described in Research Disclosure Section IV and the publications cited therein.

Multicolor photographic elements according to the invention generally comprise a blue-sensitive silver halide layer having a yellow color-forming coupler associated therewith, a green-sensitive layer having a magenta color-forming coupler associated therewith, and a red-sensitive silver halide layer having a cyan color-forming coupler associated therewith. Color photographic elements and color-forming couplers are well-known in the art. The elements according to the invention can include couplers as described in Research Disclosure Section VII, paragraphs D, E, F and G and the publications cited therein. These couplers can be incorporated in the elements and emulsions as described in Research Disclosure Section VII, paragraph C and the publications cited therein.

A photographic element according to the invention, or individual layers thereof, can also include any of a number of other well-known additives and layers. These include, for example, optical brighteners (see Research Disclosure Section V), antifoggants and image stabilizers (see Research Disclosure Section VI), light-absorbing materials such as filter layers of intergrain absorbers, and light-scattering materials (see Research Disclosure Section VIII), gelatin hardeners (see Research Disclosure Section X), oxidized developer scavengers, coating aids and various surfactants, overcoat layers, interlayers, barrier layers and antihalation layers (see Research Disclosure Section VII, paragraph K), antistatic agents (see Research Disclosure Section XIII), plasticizers and lubricants (see Research Disclosure Section XII), matting agents (see Research Disclosure Section XVI), antistain agents and image dye stabilizers (see Research Disclosure Section VII, paragraphs I and J), development-inhibitor releasing couplers and bleach accelerator-releasing couplers (see Research Disclosure Section VII, paragraph F), development modifiers (see Research Disclosure Section XXI), and other additives and layers known in the art.

Photographic elements according to the invention can be exposed to actinic radiation, typically in the visible region of the spectrum, to form a latent image as described in Research Disclosure Section XVIII, and then processed to form a visible dye image as described in Research Disclosure Section XIX. Processing can be any type of known photographic processing, although it is preferably carried out at pH 9 to 14 and includes a nucleophile such as hydrogen peroxide, hydroxylamine, perborate, an alkyl peroxide, an aryl peroxide, or compound releasing such nucleophiles.

A negative image can be developed by color development using one or more of the aforementioned nucleophiles. A positive image can be developed by first developing with a nonchromogenic developer, then uniformly fogging the element, and then developing by a process employing one or more of the aforementioned nucleophiles. If the material does not contain a color-forming coupler compound, dye images can be produced by incorporating a coupler in the developer solutions.

Development is followed by the conventional steps of bleaching, fixing, or bleach-fixing, to remove silver and silver halide, washing and drying. Bleaching and fixing can be performed with any of the materials known to be used for that purpose. Bleach baths generally comprise an aqueous solution of an oxidizing agent such as water soluble salts and complexes of iron (III) (such as potassium ferricyanide, ferric chloride, ammonium or potassium salts of ferric ethylenediaminetetraacetic acid), water-soluble dichromates (such as potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thioureas, and the like.

The invention is further illustrated by the following examples, without being limited thereby.

SYNTHESIS EXAMPLE 1

Preparation of coupler Y-1

The coupler is synthesized according to the following reaction scheme:

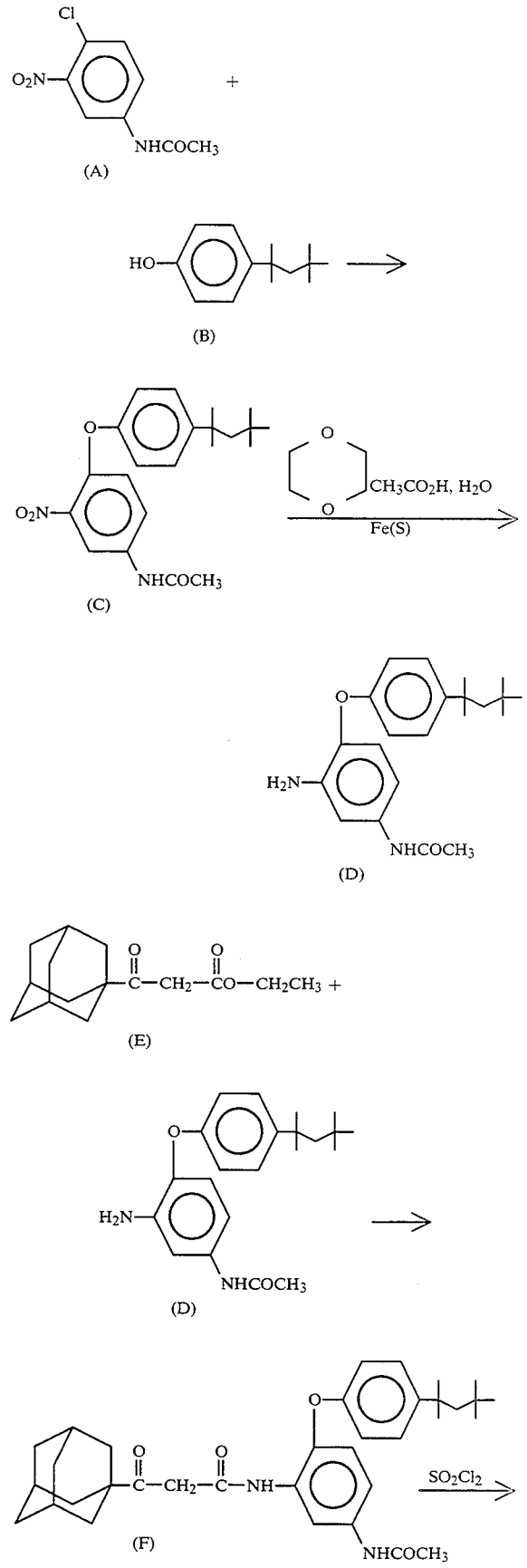

-continued

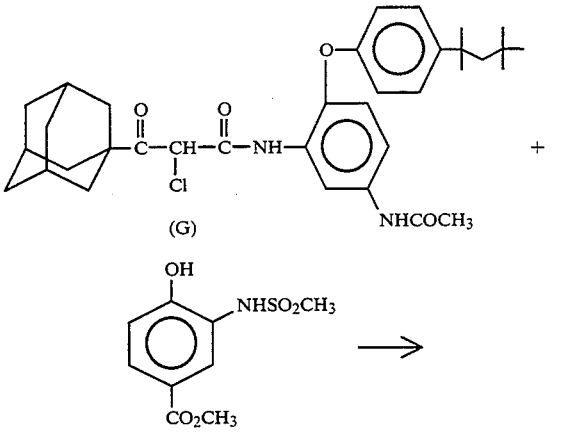

(G)

(H)

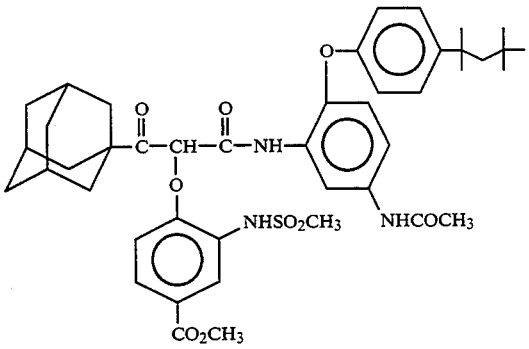

(I)

A well-stirred mixture of N-(4-chloro-3-nitro)-phenylacetamide (A) (70 g, 0.327 mole), p-tert.-octylphenol (B) (96.55 g, 0.468 mole), and potassium carbonate (129.36 g, 0.936 mole) in 350 ml of bis(2-methoxyethyl) ether was heated at reflux for 18 hours and then cooled to room temperature. The mixture was poured into a mixture of ice and water and acidified to pH 1. The brown solid was collected in vacuo and washed with water until the wash became clear. Trituration in heptane afforded the corresponding nitro compound (C) (106 g, 84%). All analytical data were consistent with the assigned structure.

A mixture of nitro compound (C) (105.5 g, 0.274 mole), dioxane (400 ml), acetic acid (140 ml) and water (100 ml) was heated at reflux for several minutes, followed by the portionwise addition of iron powder (33.52 g, 0.60 mole). The reaction mixture was heated for one hour. TLC (elution with 20% ethyl acetate in methylene chloride) showed the disappearance of the starting material. The warm reaction mixture was filtered through super-cel. The residue was then washed well with THF (500 ml) and acetic acid (300 ml). The filtrate was poured into a mixture of ice and water, and stirred for 3 hours. The resulting solid was collected in vacuo and washed with water. Drying in vacuo afforded N-(3-amino-4-(4-t-octyl)phenoxy)phenylacetanilide (D) (92.3 g, 95%). Physical and spectroscopic data were consistent with the assigned structure.

Next, a mixture of ethyl 3-(1-adamantyl)-3-oxopropionate (E) (11.29 g, 0.045 mole) and the amine (D) (14.6 g, 0.041 mole) in xylene (100 ml) was heated at reflux for 18 hours, followed by removal of the lower-boiling solvents (ethanol, xylene) by distillation. The ninhydrin test showed the disappearance of the amine (D). The mixture was concentrated in vacuo to a heavy oil, followed by trituration with ligroin. The resulting solid was collected. Drying in vacuo yielded 4-equivalent coupler (F) (16.2 g, 73%). All analytical data were consistent with the assigned structure. HPLC: 95.3%.

To a suspension of coupler (F) (11.0 g, 0.0196 mole) in dichloromethane (100 ml) at room temperature was slowly added a solution of sulfuryl chloride (2.69 g, 0.02 mole) in methylene chloride (20 ml). The reaction was allowed to warm up to room temperature and stirred for two hours. TLC (elution with 20% ethyl acetate in dichloromethane) indicated the disappearance of the starting material. Concentration in vacuo of the reaction mixture was followed by trituration with hexane, filtration, washing and drying in vacuo, to afford 10.90 g of crude product. Purification by flash silica gel chromatography (elution with 20% ethyl acetate in dichloromethane) yielded coupler (G) (6.50 g, 56%). All analytical data were consistent with the assigned structure.

To a suspension of coupler (G) (2.96 g, 5 mmole) and methyl 4-hydroxy-3-(methylsulfonamido)benzoate (H) (1.34 g, 5 mmole) in dimethylformamide (35 ml) at room temperature was added triethylamine (0.61 g, 6 mmole). The reaction was heated at 55° C. for 16 hours. The reaction was not complete, as observed by TLC, and triethylamine (0.061 g, 0.6 mmole) was added to the reaction mixture. After 4 hours, the reaction was allowed to cool to 20° C., poured into a mixture of ice and water, and acidified with hydrochloric acid to pH 1. The mixture was then extracted with two 150 ml portions of ethyl acetate. The combined extracts were washed with water, dried over anhydrous magnesium sulfate, filtered and concentrated in vacuo to afford an oil. Purification by flash silica gel chromatography ( elution with 15% ethyl acetate in dichloromethane) afforded coupler Y-1 (I) (1.9 g, 48%) as a colorless solid. All the physical and spectroscopic data were consistent with the assigned structure.

$^1$H NMR (300 MHz, $CDCl_3$): δ 8.70 (s, 1H), 8.19 (d, 2H), 7.80 (d, 1H), 7.60 (s, 1H), 7.50 (d, 1H), 7.25–7.3 (m, 3H), 6.95 (d, 1H), 6.80 (d, 2H), 6.70 (d, 1H), 5.70 (s, 1H), 3.90 (s, 3H), 2.90 (s, 3H), 2.2 (s, 3H), 2.00 (s, 3H), 1.80 (s, 3H), 1.6–1.75 (m, 14H), 1.35 (s, 6H), and 0.70 (s, 9H).

SYNTHESIS EXAMPLE 2

Preparation of coupler Y-3

The coupler is synthesized according to the following reaction scheme:

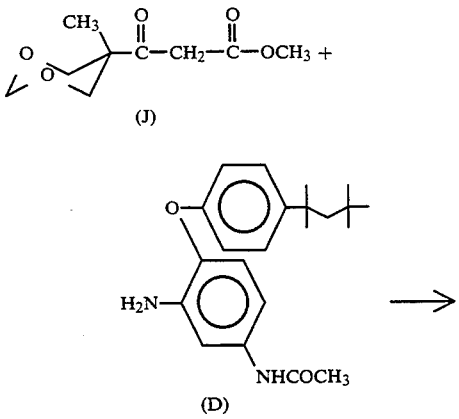

(J)

(D)

-continued

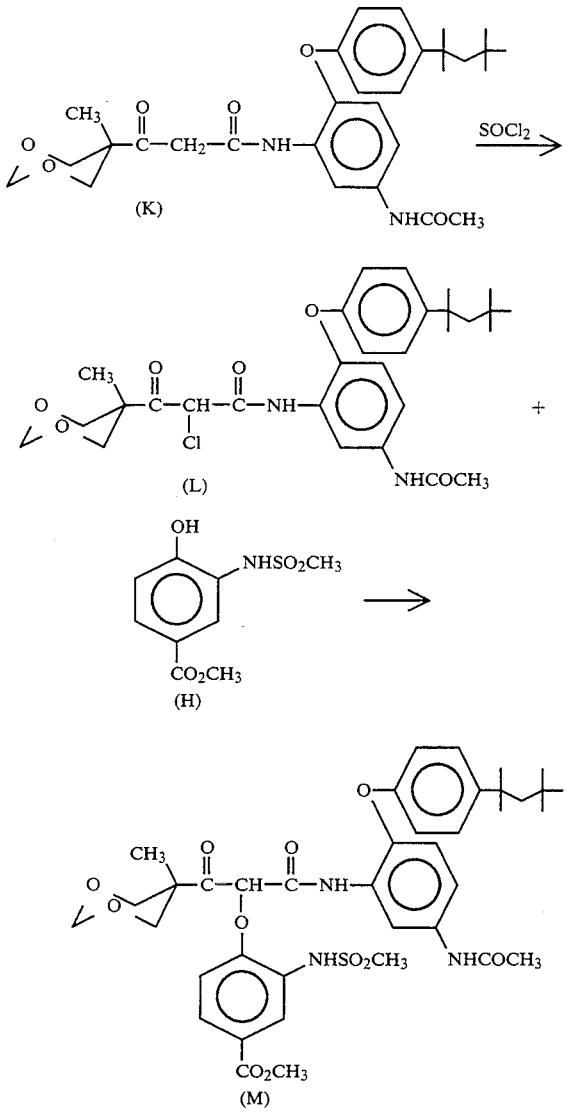

A mixture of methyl 3-(1,3-dioxo-5-methylcyclohex-5-yl)-3-oxopropionate (J) (11.91 g, 0.059 mole) (which can be prepared using the method of U.S. Pat. No. 5,118,599, the disclosure of which is hereby incorporated by reference) and amine (D) (19.0 g, 0.0536 mole) in xylene (150 ml) was heated at reflux for 18 hours. The reaction was complete, as evidenced by TLC analysis (elution with 25% ethyl acetate in dichloromethane). The ninhydrin test showed the disappearance of the amine (D). After cooling to room temperature, the mixture was poured into heptane. In vacuo collection of the resulting solid was followed by washing with ligroin and drying in vacuo, affording 4-equivalent coupler (K) (27.6 g, 98%). All analytical data were consistent with the assigned structure.

To a suspension of coupler (K) (23.0 g, 0.0438 mole) in dichloromethane (100 ml) at room temperature was slowly added a solution of sulfuryl chloride (5.44 g, 0.044 mole) in dichloromethane (25 ml). The reaction was stirred at room temperature 15 hours. TLC (elution with 20% ethyl acetate in dichloromethane) indicated the disappearance of the starting material. Concentration in vacuo of the reaction mixture yielded a heavy oil. Fresh dichloromethane was added and the solution was concentrated to yield coupler (L) as a solid (24.0 g, 98%). All analytical data were consistent with the assigned structure.

To a suspension of coupler (L) (5.58 g, 10 mmole) and methyl 4-hydroxy-3-(methylsulfonamido)benzoate (H) (2.57 g, 10.5 mmole) in dimethylformamide (50 ml) at room temperature was added triethylamine (1.22 g, 12 mmole). The reaction was heated at 50° C. for two hours. TLC indicated the disappearance of the starting materials. The reaction was cooled to 20° C., poured into a mixture of ice and water, and acidified to pH 1-2. The mixture was then extracted with two 150 ml portions of ethyl acetate. The combined extracts were washed with water, dried over anhydrous magnesium sulfate, filtered and concentrated in vacuo to afford an oil. Purification by column chromatography (silaca gel, elution with 20% ethyl acetate in dichloromethane) afforded coupler Y-3 (M) (4.61 g, 60%). All the physical and spectroscopic data were consistent with the assigned structure.

The following couplers C-1 and C-2 were used for comparison:

C-1)

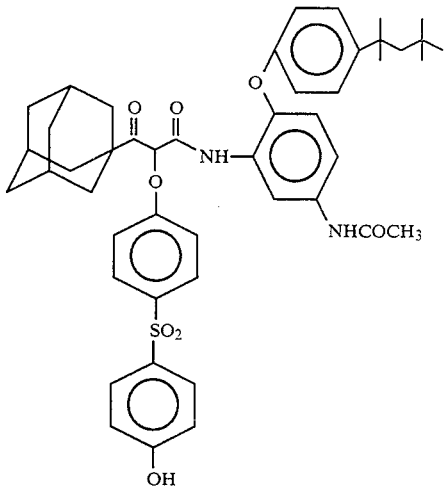

C-2)

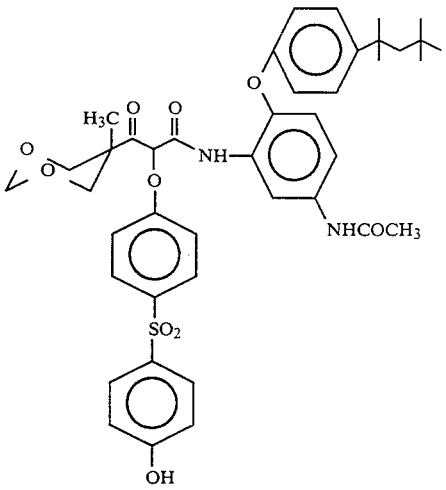

Preparation of Photographic Elements

Dispersions of the couplers were prepared in the following manner. The quantities of each component are found in Table I. In one vessel, the coupler, stabilizer (2,2'-methylenebis-(3-t-butyl-5-methylphenol) monoacetate), coupler solvent (dibutyl phthalate), and ethyl acetate were combined and warmed to dissolve. In a second vessel, the gelatin, Alkanol XC TM (E. I. DuPont Co.) and water were combined and warmed to about 40° C. The two mixtures were mixed together and passed three times through a Gaulin colloid mill. The ethyl acetate was removed by evaporation and water was added to restore the original weight after milling.

TABLE I

| Dispersion No. | Coupler No. | Grams Coupler | Grams Stabilizer | Grams Coupler Solvent | Grams Ethyl Acetate | Grams Water |
|---|---|---|---|---|---|---|
| 1 | Y-1 | 1.491 | 0.656 | 0.835 | 4.473 | 8.99 |
| 2 | C-1 | 1.500 | 0.660 | 0.840 | 4.451 | 8.94 |
| 3 | Y-1 | 1.428 | 0.628 | 0.799 | 4.283 | 9.31 |
| 4 | C-1 | 1.437 | 0.632 | 0.805 | 4.311 | 9.26 |

All Dispersions included 17.16 g of 12.5% gelatin and 2.15 g of Alkanol XC (10%).

The photographic elements were prepared by coating the following layers on a resin-coated paper support:

| | | |
|---|---|---|
| DOC | Gelatin | (1.40 g/m$^2$) |
| | bis(vinylsulfonylmethyl ether | (1.40 g/m$^2$) |
| OVERLAYER | Gelatin | (1.33 g/m$^2$) |
| | 2-(2Hbenzotriazol-2-yl)-4,6-bis-(1,1-dimethylpropyl)phenol | (0.73 g/m$^2$) |
| | Tinuvin 326 TM (Ciba-Geigy | (0.13 g/m$^2$) |
| EMULSION | Gelatin | (1.61 g/m$^2$) |
| | Coupler diapersion from Table II ($7.0 \times 10^{-4}$ mole coupler/m$^2$) | |
| | Blue-sensitized AgCl emulsion | (0.24 g/m$^2$) |
| UNDERLAYER | Gelatin | (3.23 g/m$^2$) |
| FILMBASE | Resin-coated paper support | |

Exposing and Processing of Photographic Elements

The photographic elements were given stepwise exposures to green light and processed as follows at 35° C.:

| | |
|---|---|
| Developer | 45 sec |
| Bleach-Fix | 45 sec |
| Wash (running water) | 1 min 30 sec |

The developer and bleach-fix were of the following compositions:

| | |
|---|---|
| Developer | |
| Water | 700.00 ml |
| Triethanolamine | 12.41 g |
| Anhydrous potassium carbonate | 21.16 g |
| Potassium chloride | 1.60 g |
| Potassium bromide | 7.00 mg |
| Lithium sulfate | 2.70 g |
| Lithium polystyrene sulfonate (30%) | 0.30 g |
| N-{2-[(4-amino-3-methylphenyl)ethylamino]ethyl}-methanesulfonamide, sesquisulfate | 5.00 g |
| N,N-Diethylhydroxylamine (85%) | 5.40 g |
| 1-Hydroxyethyl-1-diphosphonic acid (60%) | 0.81 g |
| Blankophor REU TM (Mobay Corp.) | 2.30 g |
| Water to make 1 liter, pH 10.4 ± 0.05 @ 26.7° C. | |
| Bleach-Fix | |
| Water | 700.0 ml |
| Solution of ammonium thiosulfate (56.4%) + ammonium sulfite (4%) | 127.40 g |
| Sodium metabisulfite | 10.00 g |
| Acetic acid (glacial) | 10.20 g |

-continued

| | |
|---|---|
| Solution of ammonium ferric ethylenediaminttetraacetate (44%) + ethylenediaminttetraacetate acid (3.5%) | 110.40 g |
| Water to make 1 liter. pH 6.7 @ 26.7° C. | |

Photographic Tests

Yellow dyes were formed upon processing. The following photographic characteristics were determined: Dmax (maximum density to blue light); Dmin (minimum density to blue light); Contrast (slope of a line connecting the two points on the Density v. Log Exposure (D vs logE) curve at which logE is 0.3 less and 0.3 more, respectively, than the point at which the density is 1.0); Lmax (wavelength of maximum spectral absorption of the dye). These values for each example are tabulated in Table II.

TABLE II

| Coupler | Dmax | Dmin | Contrast | Hue |
|---|---|---|---|---|
| Y-1 | 1.79 | 0.07 | 2.05 | 441 |
| C-1 | 1.46 | 0.06 | 1.63 | 441 |
| Y-1 | 2.08 | 0.08 | 2.53 | 446 |
| C-1 | 1.71 | 0.09 | 2.24 | 446 |

The monocyclic or multicyclic moieties present in the yellow couplers according to the invention give rise to less steric hindrance than the tertiary butyl group present in the pivaloylacetanilide-class yellow couplers. Consequently, it was expected that the dioxanoylacetanilide and adamantoylacetanilide class yellow couplers having the less bulky, ionizable SDP coupling-off group would be more reactive than the same couplers having the more bulky aryloxy coupling-off group having an ortho polarizable functional group. As shown in Tables III and IV below, this is indeed the case with the pivaloylacetanilide-class yellow couplers.

TABLE III

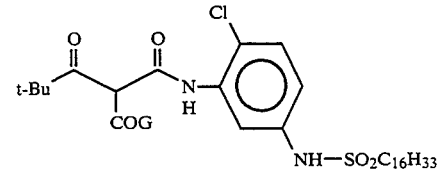

| COG | $D_{max}$ | $D_{min}$ | Contrast | $\lambda_{max}$ |
|---|---|---|---|---|
| | 2.46 | 0.08 | 1.82 | 445 |

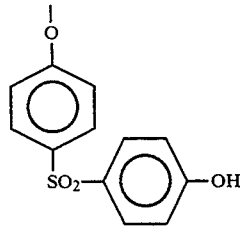

TABLE III-continued

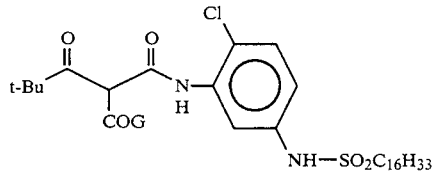

| COG | $D_{max}$ | $D_{min}$ | Contrast | $\lambda_{max}$ |
|---|---|---|---|---|
| 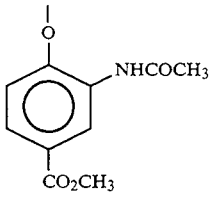 | 2.08 | 0.08 | 1.49 | 445 |

TABLE IV

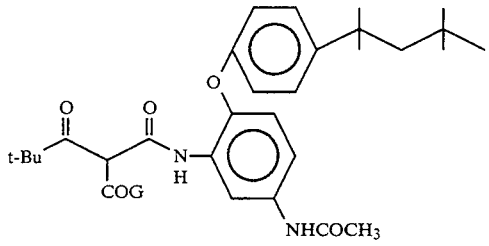

| COG | $D_{max}$ | Contrast |
|---|---|---|
| 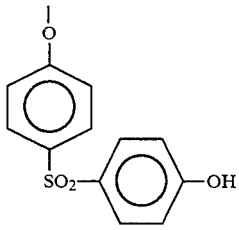 | 2.01 | 2.45 |
| 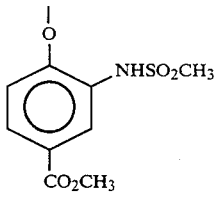 | 1.89 | 2.29 |

However, the opposite was found to be true with the yellow couplers according to the invention. The inventive couplers containing a more bulky aryloxy coupling-off group having an ortho polarizable functional group displayed higher coupling efficiencies than the corresponding couplers having a less bulky SDP coupling-off group.

As is evident from Table II, the yellow couplers according to the present invention are significantly more active and efficient in terms of Dmax and contrast than the comparative couplers. The enhanced coupling efficiency achieved by the yellow couplers according to the invention was unique and unexpected.

It is to be understood that the foregoing detailed description and specific examples, while indicating preferred embodiments of the present invention, are given by way of illustration and not limitation. Many changes and modifications within the scope of the present invention may be made without departing from the spirit thereof, and the invention includes all such modifications.

What is claimed is:

1. A photographic element comprising a support and a silver halide emulsion layer having associated therewith a yellow dye-forming coupler comprising (a) an acyl acetanilide in which the acyl group includes a monocyclic or multicyclic carbon center of a group $R^0$ selected from $R^0$

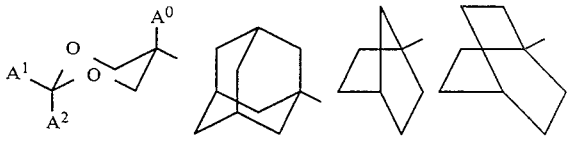

wherein $A^0$ denotes unsubstituted or substituted alkyl, aryl or aralkyl;

$A^1$,$A^2$ independently denote hydrogen or unsubstituted or substituted alkyl, aryl or aralkyl;

attached to the carbonyl moiety, and (b) an aryloxy coupling-off group COG at the coupling position of the acylacetanilide, said coupling-off group having in the ortho position a polarizable substituent, wherein the coupling-off group is

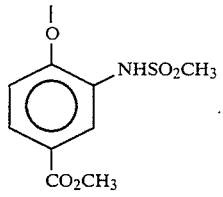

2. A photographic element as claimed in claim 1, wherein said yellow dye-forming coupler is represented by the formula

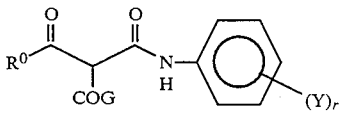

wherein

Y denotes hydrogen, halogen, CN, $CF_3$, $—C(O)_nR^1$, $—CR^1R^2C(O)_nR^1$, $—CR^1R^2CONR^1R^2$, $—COO(CH_2—CH_2—O)_pR^1$, $—CONR^1R^2$, $—CONR^1(CH_2CH_2—O)_pR^2$, $—NO_2$, $—NR^1S(O)_nR^2$, $—NR^1S(O)_nNR^1R^2$, $—NR^1COR^2$, $—NR^1COCH(R^1)(OR^2)$, $—NR^1CONR^1R^2$, $—OR^1$, $—O(CH_2)_qR^1$, $—O(CH_2—CH_2—O)_pR^1$, $—O(CH_2—CH_2—O)_pCOOR^1$, $—O(CH_2—CH_2O)_pCONR^1R^2$, $—S(O)_nR^1$, $—S(O)_nNR^1R^2$, or $—S(O)_nNR^1(CH_2CH_2—O)_pR^2$;

'$R^1$,$R^2$ independently denote hydrogen or unsubstituted or substituted alkyl, aryl or heterocyclyl, or together complete a heterocyclic ring with the nitrogen, oxygen or phosphorus atoms to which they are attached;

p, q, independently denote an integer from 1 to 3; and r denotes an integer from 1 to 4, and wherein COG is the coupling-off group.

3. A photographic element as claimed in claim 2, wherein $R^0$ is an adamantyl group.

4. A photographic element as claimed in claim 2, wherein $R^0$ is a 5-methyl-1,3-dioxanyl group.

5. A photographic element as claimed in claim 2, wherein $R^0$ is a bicyclo[2,2,1]heptyl group.

6. A photographic element as claimed in claim 2, wherein $R^0$ is a bicyclo[2,2,21octyl group.

7. A photographic element as claimed in claim 2, wherein said yellow dye-forming coupler comprises a ballast group.

8. A photographic element as claimed in claim 1, wherein said yellow dye-forming coupler is selected from the group consisting of:

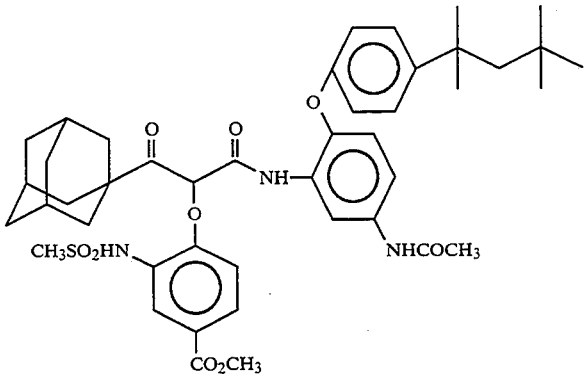

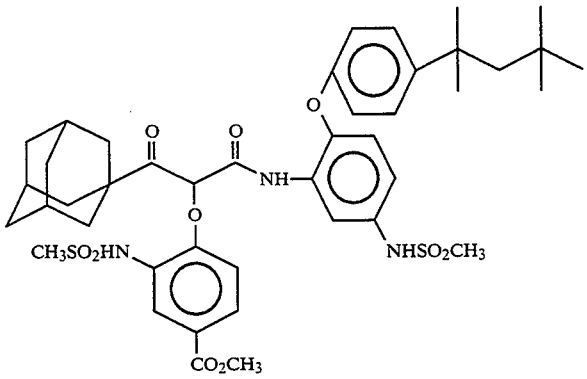

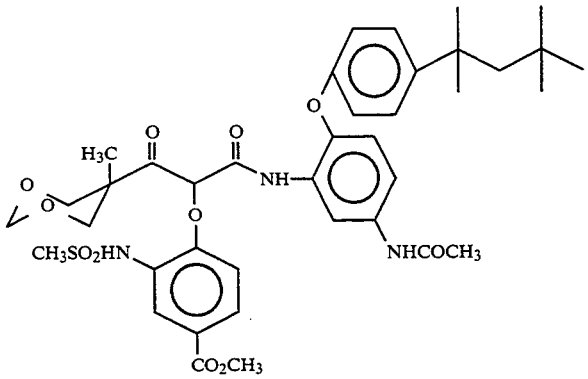

-continued
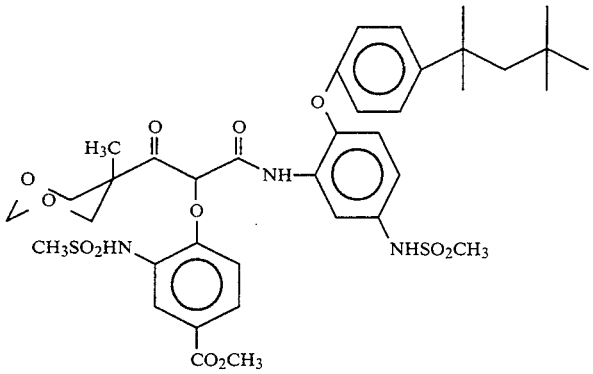
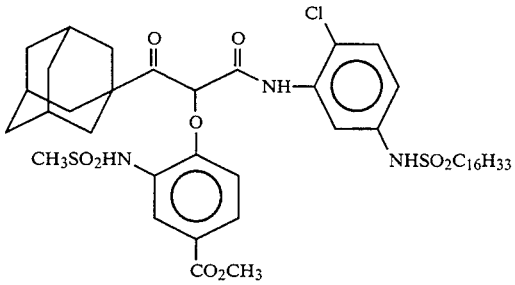
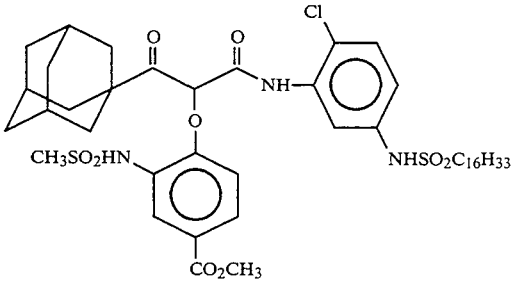
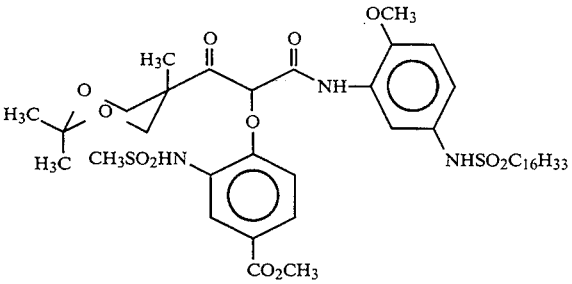
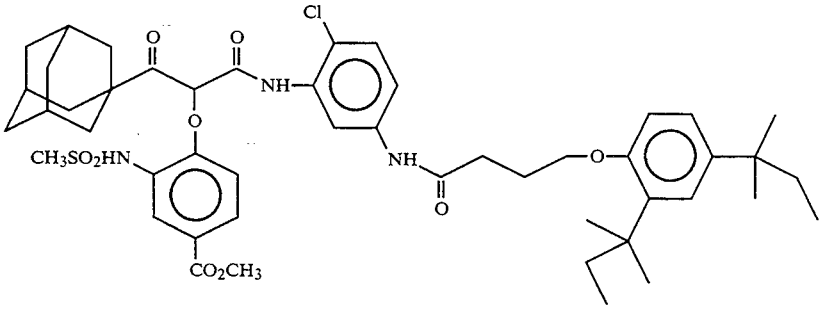

-continued

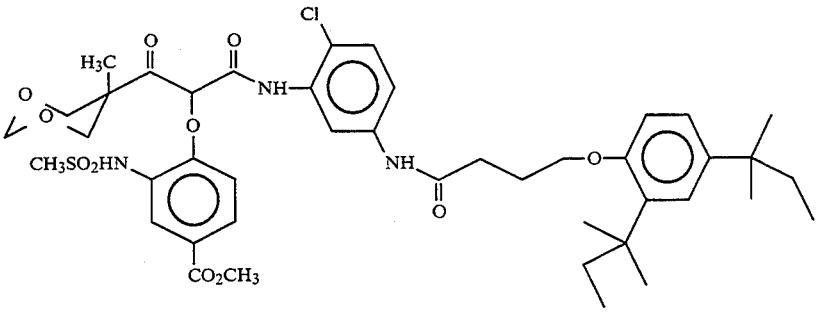

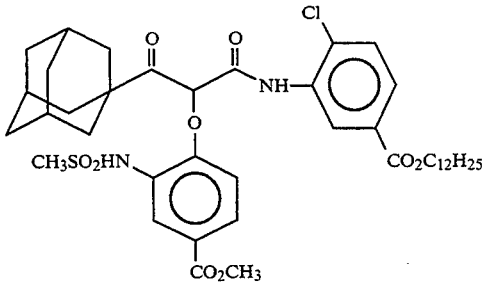

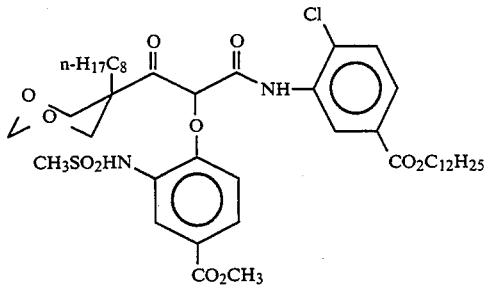

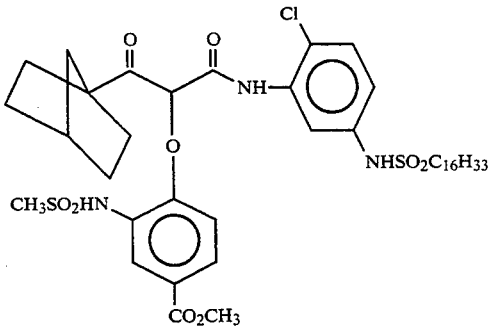

9. A photographic element as claimed in claim 1, wherein $R^0$ is an adamantyl group.

10. A photographic element as claimed in claim 1, wherein $R^0$ is a 5-methyl-1,3-dioxanyl group.

11. A photographic element as claimed in claim 1, wherein $R^0$ is a bicyclo[2,2,1]heptyl group.

12. A photographic element as claimed in claim 1, wherein $R^0$ is a bicyclo[2,2,21octyl group.

13. A photographic element as claimed in claim 1, wherein said coupler comprises a ballast group.

14. A photographic element as claimed in claim 1, wherein said yellow-dye forming coupler is:

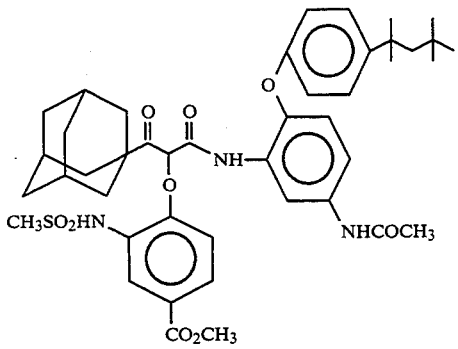

15. A photographic element as claimed in claim 1, wherein said yellow-dye forming coupler is:

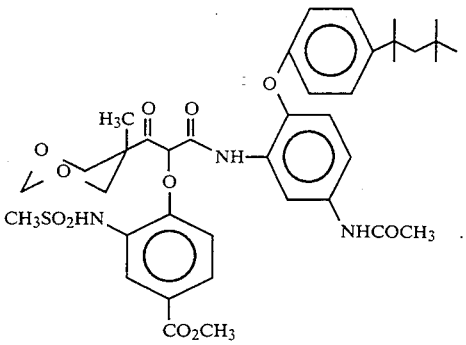

16. A multicolor photographic element comprising a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler, wherein said yellow dye-forming coupler is a coupler comprising (a) an acyl acetanilide in which the acyl group includes a monocyclic or multicyclic carbon center of a group $R^0$ selected from

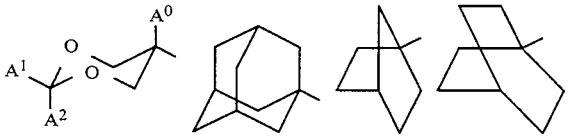

$R^0$ $A^0$ denotes unsubstituted or substituted alkyl, aryl or aralkyl;

$A^1$,$A^2$ independently denote hydrogen or unsubstituted or substituted alkyl, aryl or aralkyl;

attached to the carbonyl moiety, and (b) an aryloxy coupling-off group COG at the coupling position of the acylacetanilide, said coupling-off group having in the ortho position a polarizable substituent, wherein the coupling-off group is [selected from the group consisting of

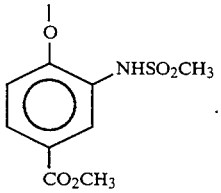

17. A process for developing an image in a photographic element comprising a support and a silver halide emulsion containing an imagewise distribution of developable silver halide grains, said process comprising the step of developing said element with a silver halide color developing agent in the presence of a yellow dye-forming coupler comprising (a) an acyl acetanilide in which the acyl group includes a monocyclic or multicyclic carbon center of a group $R^0$ selected from

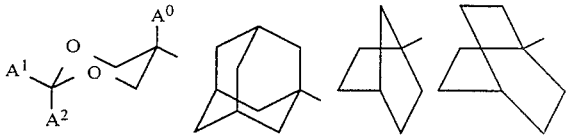

$R^0$ $A^0$ denotes unsubstituted or substituted alkyl, aryl or aralkyl;

$A^1$,$A^2$ independently denote hydrogen or unsubstituted or substituted alkyl, aryl or aralkyl;

attached to the carbonyl moiety, and (b) an aryloxy coupling-off group COG at the coupling position of the acylacetanilide, said coupling-off group having in the ortho position a polarizable substituent, wherein the coupling-off group is [selected from the group consisting of

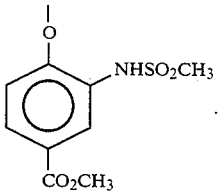

18. A photographic silver halide emulsion containing a yellow dye-forming coupler comprising (a) an acyl acetanilide in which the acyl group includes a monocyclic or multicyclic carbon center of a group $R^0$ selected from

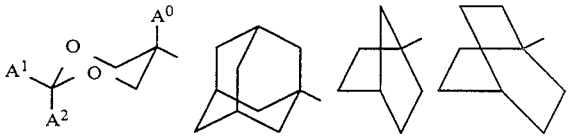

$R^0$ $A^0$ denotes unsubstituted or substituted alkyl, aryl or aralkyl;

$A^1$, $A^2$ independently denote hydrogen or unsubstituted or substituted alkyl, aryl or aralkyl;

attached to the carbonyl moiety, and (b) an aryloxy coupling-off group COG at the coupling position of the acylacetanilide, said coupling-off group having in the ortho position a polarizable substituent, wherein the coupling-off group is [selected from the group consisting of

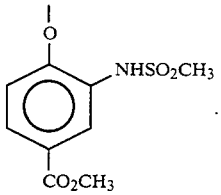

* * * * *